US005665173A

United States Patent [19]

Lee

[11] Patent Number: 5,665,173

[45] Date of Patent: Sep. 9, 1997

[54] MOVIE FILM CLEANING PROCESS

[75] Inventor: Burnell Lee, Baton Rouge, La.

[73] Assignee: Albemarle Corporation, Richmond, Va.

[21] Appl. No.: 609,316

[22] Filed: Feb. 29, 1996

[51] Int. Cl.[6] ..... B08B 7/00; C23G 5/028; C23G 5/024; C11D 7/50

[52] U.S. Cl. ..... 134/40; 134/15; 134/25.5; 134/32; 134/38; 510/169

[58] Field of Search ..... 134/14, 15, 25.5, 134/32, 38, 40, 42; 510/169

[56] References Cited

U.S. PATENT DOCUMENTS

| | | | |
|---|---|---|---|
| 2,371,645 | 3/1945 | Aitchison et al. | 134/31 |
| 2,870,094 | 1/1959 | Cathcart | 510/169 X |
| 3,730,904 | 5/1973 | Clementson et al. | 252/171 |
| 3,773,677 | 11/1973 | Boyles | 252/172 |
| 4,056,403 | 11/1977 | Cramer et al. | 134/22 R |
| 4,107,077 | 8/1978 | Sullivan, Jr. et al. | 252/408 |
| 4,652,389 | 3/1987 | Moll | 252/90 |
| 4,900,456 | 2/1990 | Ogilvy | 252/8.551 |
| 5,102,573 | 4/1992 | Han et al. | 252/153 |
| 5,190,678 | 3/1993 | Swartz et al. | 252/18 |
| 5,207,953 | 5/1993 | Thorssen et al. | 252/601 |
| 5,320,683 | 6/1994 | Samejima et al. | 134/40 |
| 5,403,507 | 4/1995 | Henry | 252/170 |
| 5,492,645 | 2/1996 | Oshima et al. | 252/171 |

FOREIGN PATENT DOCUMENTS

| | | |
|---|---|---|
| 0609004 | 8/1994 | European Pat. Off. . |
| 4-161234 | 6/1992 | Japan . |
| 6128591 | 5/1994 | Japan . |
| 7150197 | 6/1995 | Japan . |

OTHER PUBLICATIONS

K.W. Suh et al. *J. Polym. Sci. Part A-2* 1968, 6, 813–823.

Kirk-Othmer *Encyclopedia Of Chemical Technology*, "Blood, Coagulants and Anticoagulants to Cardiovascular Agents", Third Edition, vol. 4, (1978), John Wiley & Sons, Inc., New York, pp. 256, 257, 262.

NFPA 325—National Fire Protection Association, Inc., *Guide to Fire Hazard Properties of Flammable Liquids, Gases, and Volatile Solids*, 1994 Edition, prepared by the Technical Committee on Classification and Properties of Hazardous Chemical Data, pp. 325-1—325-94.

Dipsol Chemicals Co., Ltd., Product Brochure entitled "Dipsol SC-52A—Cleaning Agent Substitute for Freon and Chlorine Solvents", date unknown, pp. 1–13 (w/translation—pp. 1–17).

Abstract—Great Britain Patent No. 1276783-A, publication date unknown, assigned to Imperial Chemical Inds Lt, entitled "Stabilised trichloroethane—containing nitromethane and heterocyclic nitrogen compounds".

Abstract—Japanese Patent No. 03173835-A published Jul. 29, 1991, assigned to Asahi Glass, entitled "New stabilising (pseudo) azeotropic tri: cloro: di: fluoroethane composition useful as substitute freon and for heat transfer medium, foaming agent and precision instrument parts".

*Primary Examiner*—Arlen Soderquist

*Attorney, Agent, or Firm*—E. E. Spielman, Jr.

[57] ABSTRACT

This invention relates to a solvent system and process for cleaning cellulose triacetate polymer camera film. The solvent system comprises n-propyl bromide and an alkane containing 6 to 7 carbon atoms.

5 Claims, No Drawings

MOVIE FILM CLEANING PROCESS

BACKGROUND OF THE INVENTION

This invention relates to an environmentally friendly solvent for use in cleaning movie film, in particular, cellulose triacetate film.

Movie film is designed for repetitive use and, as such, must be durable and true to its original shape and size over a long period of time. Curling, cracking or peeling of the film is not tolerable.

In addition, the film must be kept clean from skin oils, dust and other matter which can be deposited during film processing and handling. It is generally necessary to clean movie film several times during its life. Cleaning is conveniently done by immersing the film in a solvent which is contemporaneously subjected to sonication. The solvent is contained in a tank and the film is fed through the tank via film guides. The film is dried as it is removed from the tank and is rewound. The solvent must be capable of cleaning the film without leaving a deposit on the film and without causing any distortion or damage to the film. Heretofore, a preferred solvent has been 1,1,1-trichloroethane. However, this solvent is no longer favored as it is to soon be banned world-wide for solvent applications due to environmental concerns.

Environmental concerns could be attenuated if an alkyl bromide solvent could be used instead of 1,1,1-trichloroethane. This would be especially so if n-propyl bromide could be the solvent as it has good cleaning characteristics, a low boiling point and is environmentally friendly, e.g. its Ozone Depletion Potential is low as compared to 1,1,1-trichloroethane. The low boiling point is advantageous as it insures that there will be no or very little solvent residue left on the cleaned film. n-Propyl bromide was tried on several types of film and was found to be suitable except for films based on cellulose triacetate polymer. For this last type of film, the n-propyl bromide caused unacceptable curling. Despite this fatal infirmity, the benefits of using n-propyl bromide made it well worthwhile to investigate the problem and to search for a solution which would yield an n-propyl bromide based solvent which did not cause film curl but which still retained the benefits of n-propyl bromide.

THE INVENTION

This invention relates to a environmentally friendly solvent system suitable for use in cleaning cellulose triacetate polymer based camera film. The solvent systems of this invention comprise 40 to 70 wt % n-propyl bromide product and 60 to 30 wt % alkane, the alkane containing 6–7 carbon atoms. The weight percentages are based upon the total weight of n-propyl bromide product and alkane in the solvent system.

The n-propyl bromide product used in the solvent systems of this invention can be pure n-propyl bromide or any of the commercially available products which are preferably of high purity, i.e. at least 98+ wt % n-propyl bromide. Lower purity product may be used, say 94 to 97 wt % n-propyl bromide. The main impurity in most all cases is iso-propyl bromide. Iso-propyl bromide is a process impurity and its presence can be reduced by distillation. Thus, for the purposes of this invention, the term "n-propyl bromide product" is to mean pure n-propyl bromide or a product which contains n-propyl bromide and up to 6 wt % normally occurring process impurities, the most prominent of which is often iso-propyl bromide. The most preferred n-propyl bromide product is that which is 99+ wt % pure n-propyl bromide. The weight percentages are based upon the total weight of the n-propyl bromide product.

The alkane constituent in the solvent system is preferably n-hexane, n-heptane or a mixture thereof. The most preferred alkane is n-hexane as it has a boiling point approximate to that of n-propyl bromide. Thus, drying can occur at a lower temperature than that which will be necessary for the higher boiling heptane.

The respective amounts of n-propyl bromide product and alkane, is, as before noted, about 40 to about 70 wt % n-propyl bromide product and about 60 to about 30 wt % alkane. Preferably, the n-propyl bromide product is present in an amount of about 50 to about 70 wt % with the alkane being present in an amount of about 50 to about 30 wt %. Especially preferred are 50/50 and 66/33 blends of n-propyl bromide product to alkane. The weight percents are based on the total amount of n-propyl bromide product and alkane present in the solvent system.

The n-propyl bromide product and alkane are highly miscible one with the other and thus, the two can be conventionally mixed together with no particular requirements needed.

The solvent systems of this invention can include additional constituents. For example, the n-propyl bromide can be stabilized against decomposition should it come in contact with a metal such as magnesium, titanium, steel or aluminum. These metals can act as catalysts which dehydrobrominate the n-propyl bromide. The dehydrobromination product is HBr which can, in turn, attack metal and leave it corroded.

Generally, any of the conventional stabilizers which are taught by the art to be useful in stabilizing halogenated hydrocarbon solvents are suitable for use in this invention, the only caveat being that the stabilizer not adversely affect the film to be cleaned. The stabilizer may be a singular stabilizer or a combination of stabilizers. The stabilizers can be nitroalkanes, ethers, epoxides, amines or any combination thereof. Preferred are the epoxides.

Some art recognized nitroalkanes are nitromethane, nitroethane, 1-nitropropane, 2-nitropropane and nitrobenzene. Preferred is nitromethane. They are usable either singularly or in form of a mixture of two or more.

The ethers include 1,2-dimethyoxyethane, 1,4-dioxane, 1,3-dioxolane, diethyl ether, diisopropyl ether, dibutyl ether, trioxane, alkyl cellosolves in which the alkyl group has 1 to 10 carbon atoms such as methyl cellosolve, ethyl cellosolve and iso-propyl cellosolve, acetal, acetone dimethyl acetal, 2,2-dimethoxypropane, diethoxymethane, acetaldehyde, dimethylacetal, dimethoxymethane, γ-butyrolactone, methyl t-butyl ether, tetrahydrofuran and N-methylpyrrole. They are usable either singularly or in the form of a mixture of two or more.

The epoxides include epichlorohydrin, propylene oxide, butylene oxide, cyclohexene oxide, glycidyl methyl ether, glycidyl methacrylate, pentene oxide, cyclopentene oxide and cyclohexene oxide. Preferred is 1,2-epoxybutane. They are usable either singularly or in the form of a mixture of two or more.

The amines include hexylamine, octylamine, 2-ethylhexylamine, dodecyl-amine, ethylbutylamine, hexylmethylamine, butyloctylamine, dibutylamine, octadecyl-methylamine, triethylamine, tributylamine, diethyloctylamine, tetradecyldimethylamine, diisobutylamine, diisopropylamine, pentylamine, N-methylmorpholine, iso-propylamine, cyclohexylamine, butylamine, isobutylamine, dipropylamine, 2,2,2,6-tetramethylpiperidine, N,N-di-allyl-p-phenylenediamine, diallyamine, aniline, ethylenediamine, propylenediamine, diethylenetriamine, tetraethylenepentamine, benzylamine, dibenzylamine, diphenylamine and diethylhydroxyamine. They are usable either singularly or in the form of a mixture of two or more of them.

A preferred stabilizer is 1,2-butylene oxide.

The amount of stabilizer used can be the conventional amount, e.g. from above 0.1 wt % to 15 wt %, with the weight percent being based upon the total weight of the n-propyl bromide product in the solvent. A most preferred stabilizer amount is 0.25–1.0 wt % 1,2-butylene oxide. The weight percent is based upon the total weight of the solvent system.

The solvent system of this invention is used conventionally and could be seen as a suitable replacement for 1,1,1-trichloroethane. The solvent system is kept at a bath temperature within the range of from about 20° to about 45° C. The residency time for the film in the bath is conventional, say 0.1 to 5 seconds. The film drying temperature is about 25° to 35° C.

The cellulose triacetate polymer based camera films discussed herein are available from Eastman Kodak Company. These camera films are used in movie cameras.

As the following examples illustrate, the film curling tendencies of n-propyl bromide is obviated by the presence of an alkane in the solvent system.

EXAMPLES

A solvent system bath at room temperature was provided in a vessel. Into the bath was immersed processed Eastman Kodak Company color negative camera film. The film was a cellulose triacetate polymer based film. The immersion lasted for 10 minutes. The film was removed and dried at room temperature. The dried film was then examined for curling, cracking and peeling. The following Table gives the results obtained for several runs.

TABLE

| Solvent System | Curling | Cracking | Peeling | Discoloration* |
|---|---|---|---|---|
| 1,1,1-TCE | none | none | none | none |
| 99 wt % NPB | slight curl | none | none | none |
| 50/50 wt % NPB/HEX | none | none | none | none |
| 50/50 wt % NPB/HEPT | none | none | none | none |
| 95/05 wt % NPB/HEX | curling | none | none | none |
| 90/10 wt % NPB/HEX | curling | none | none | none |

* — discoloration of the solvent system
TCE — trichloroethane
NPB — n-propyl bromide
HEX — n-hexane
HEPT — n-heptane

I claim:

1. A process for cleaning cellulose triacetate polymer based camera film, which process comprises immersing the film into a solvent system then removing and drying the film, wherein the solvent system is comprised of from about 40 to about 70 wt % of a n-propyl bromide product and from about 60 about to about 30 wt % alkane containing 6 to 7 carbon atoms.

2. The process of claim 1 wherein the n-propyl bromide product is present in an amount of from 50 to about 70 wt % n-propyl bromide and wherein the alkane is present in an amount of from about 50 to about 30 wt %.

3. The process of claim 2 wherein the alkane is n-hexane, n-heptane or a mixture thereof.

4. The process of claim 1 wherein the alkane is n-hexane, n-heptane or a mixture thereof.

5. The process of claim 1 wherein the alkane is n-hexane, n-heptane or a mixture thereof and wherein the n-propyl bromide product is present in an amount of from about 50 to about 66 wt % and wherein the alkane is present in an amount of from about 50 to about 33 wt %.

* * * * *